United States Patent [19]

Schroeder

[11] Patent Number: 4,997,047

[45] Date of Patent: Mar. 5, 1991

[54] HIGH SPEED ELECTROMAGNETICALLY ACCELERATED EARTH DRILL

[76] Inventor: Jon M. Schroeder, 14301 Bagdad Rd., Leander, Tex. 78641

[21] Appl. No.: 491,276

[22] Filed: Mar. 9, 1990

[51] Int. Cl.[5] ..... E21B 7/26; E21B 7/00

[52] U.S. Cl. ..... 175/4.5; 175/4.57; 175/19; 175/62; 175/162

[58] Field of Search ..... 175/19, 4.5, 4.57, 162, 175/170, 62

[56] References Cited

U.S. PATENT DOCUMENTS

| | | | |
|---|---|---|---|
| 3,695,715 | 10/1972 | Godfrey | 175/4.5 |
| 4,004,642 | 1/1977 | Dardick | 175/4.5 |
| 4,030,557 | 6/1977 | Alvis et al. | 175/4.5 |

FOREIGN PATENT DOCUMENTS

| | | | |
|---|---|---|---|
| 264999 | 6/1970 | U.S.S.R. | 175/19 |
| 386093 | 9/1973 | U.S.S.R. | 175/19 |
| 397609 | 1/1974 | U.S.S.R. | 175/19 |
| 1406314 | 6/1988 | U.S.S.R. | 175/19 |

*Primary Examiner*—Hoang C. Dang
*Attorney, Agent, or Firm*—Joseph F. Long

[57] ABSTRACT

The disclosure describes an apparatus to use multiple expendable electromagnetically accelerated drill heads that are propelled into a electromagnetic accelerator that further accelerates the expendable drill heads to velocities as high as 30,000 ft./second to drill horizontal holes. Acceleration is achieved by making use of electromagnetic forces induced in a coil by opening a charged "ringing" circuit containing a capacitor interacting with magnetic poles around the expendable projectiles or drill head. Multiple accelerating coils, each charged by a D.C. source, are used while initial acceleration may be by interaction of electromagnetic fields between conductive rings on the drill head and induction coils.

10 Claims, 2 Drawing Sheets

HIGH SPEED ELECTROMAGNETICALLY ACCELERATED EARTH DRILL

BACKGROUND OF THE INVENTION

This invention is related of my patent application entitled A FUEL ASSISTED ELECTROMAGNETIC LAUNCHER, Ser. No. 07/435,616, filed Nov. 13, 1989. Significant improvements to the accelerator unit of this invention have been made while working on contract number N00039-89-CO231 for the Department of Navy, Space and Naval Warfare Systems Command.

There exists a need to rapidly and inexpensively drill holes through earth in vertical, slanted and horizontal positions. Oil wells are now drilled vertically or nearly so, usually with a slow rotary drill. Water wells are drilled vertically with a hammer type impact drill as a rotary drill, usually in a vertical position. Usually ditching machines are used to dig the ditches, for laying pipe, burying cables and installing fiber optic cables. There is a need for a method for horizontal drilling through mountains, under buildings, under roads, through rock and shale that is more cost effective than present ditching type techniques for laying pipe, cable, fiber optic cable, etc. Fiber optic cables need to be both level and straight for optimum transmission speed. This invention uses an expendable electromagnetically accelerated drilling projectile or drill head to drill a hole by hyper velocity impact. The nearest prior art we find is my pending patent application for a Fuel Assisted Electromagnetic launcher. However, this invention differs significantly in using induced current to form an electromagnetic field for a self-starting drill head and in that the drill head is filled with ice for mass and rigidity. This compares with a rocket fuel accelerated launcher with magnetic field formed using thermopile rings in my pending patent for a Fuel Assisted Electromagnetic Launcher.

SUMMARY OF THE INVENTION

The method for drilling horizontal holes in this invention uses a rigid housing to contain means to cool and maintain frozen water in an expendable drill head with metallic induction rings. The expendable drill head is aligned with the central cylindrical openings of multiple conductive wire coils and separating spacers of the coils of an electromagnetic accelerator. Circuitry of each of the multiple conductive wire coils produces an alternating electromagnetic force when a tip end of the expendable drill head interrupts a photo-electric cell circuit that acts to open a nano-second switch in a charging circuit for each coil. The circuit to each coil includes a variable or fixed capacitor across the inlet leads. The frequency of the alternating electromagnetic force produced is controlled by the capacity of the capacitor while strength of the electromotive force is controlled by the charging voltage and construction of the coil.

The coils may be relatively slowly charged using batteries or homopolar generators. Nano-second switches are used to open the circuit to cause an alternating electromotive force and must be properly timed with arrival of the projectile or drill head as it is accelerated through the magnetic accelerator.

Acceleration is determined by strength of the electromotive forces generated in the accelerator coils and strength of the magnetic poles on the expendable drill head and timing to have maximum interaction. Direct current charged coils induce current in aluminum or copper rings or other type conductive rings around the drill head and opening the circuit allows production of high strength alternately aligned magnetic poles for the short duration time needed for acceleration through the electromagnetic accelerator to increase the speed after the drill head has been propelled into the accelerator by interaction of magnetic field as a circuit is broken in the D.C. induction coils. Expected residence time in the unit should be less than one hundredth of a second.

The accelerator is prestressed to avoid separation of the coils during use and is mounted on heavy rails with shock absorbers to minimize recoil and return the accelerator to position for continued use. Adjustable mounting pads may be automatically adjusted to maintain the unit in proper alignment as the expendable drill heads are serially fed into the accelerator unit.

In use, earth would be excavated to set the unit and serially fed expendable drill heads would be used to drill to desired length. In long length holes the unit would be reset in new excavations until desired total length of the drilled hole is reached.

DESCRIPTION OF PREFERRED EMBODIMENT

The method of drilling horizontal holes of this invention uses hardware best described from the drawings. The drawings all refer to a preferred embodiment but we will also describe some variations useable in other embodiments.

Figure 1:
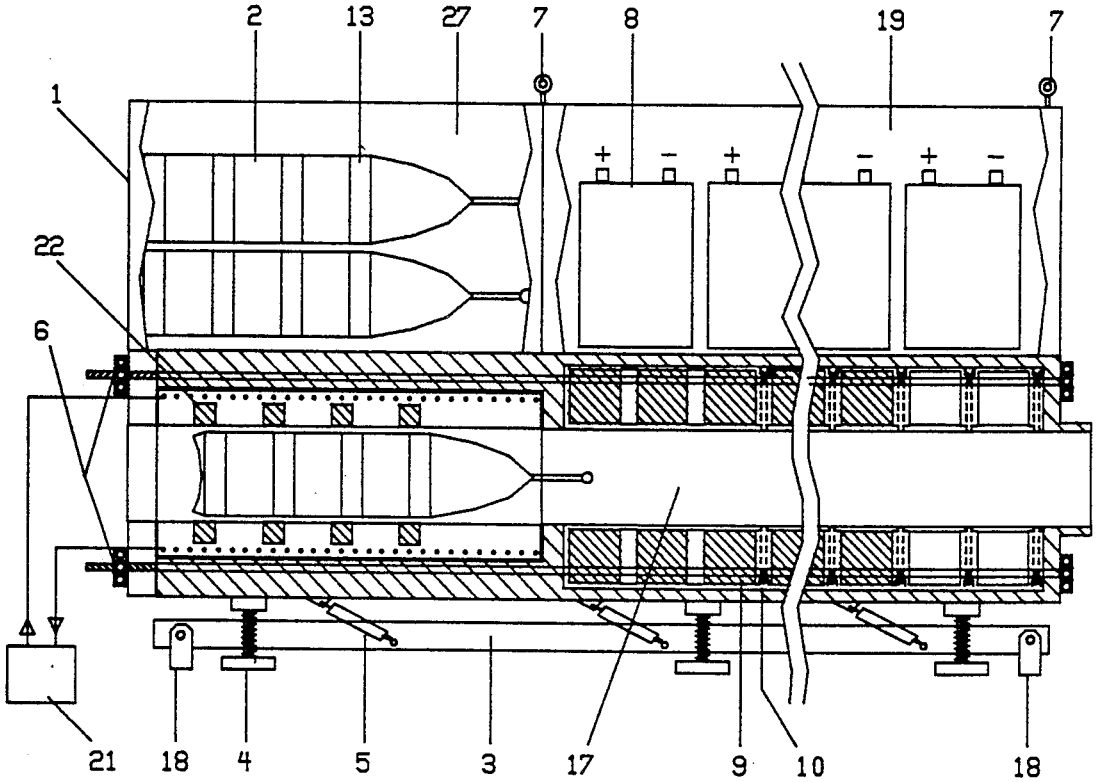
FIG. 1 shows a side view of the assembly.

In FIG. 1 we show a section view indicating major hardware and arrangement. The unit 1 is meant to be moved using power means such as a crane or winch truck and lifting lugs 7. In use, an excavation to hold the unit 1 must be made to position the barrel 17 for drilling a horizontal hole. Proper alignment is critical and the flat base 3 is equipped with four adjustable vertical support-pads 4 and four adjustable side pads or jacks 18 to allow proper horizontal and lateral adjustment. A surveyor transit would be used to for measurement to ascertain proper positioning. The base 3 would be weighted with concrete and multiple heavy duty shock absorbers 5 would be used to absorb recoil in a preferred embodiment. In other embodiments the recoil may be handled in several ways such as by bolting to a very heavy base, spring loading, and even by counter pressuring explosive charges properly timed.

In the unit, a storage compartment 27 holds expendable drill heads 2 in a preferred embodiment the drillhead may be a hollow cylindrical plastic container encircled with a minimum of two conductive rings and filled with water. Means to cool and freeze water in the drill head 2 and induction coils 22 may be included in the preacceleration storage compartment 20. Accelerator coils 9 and spacer coils 10 form the accelerator barrel 17. The accelerator coils 9 are wound using an insulated conductor such as aluminum or copper encapsulated in a hard plastic such as epoxy. Spacer rings 10 may be made from hard non-conductor material or reinforced plastic composition. A minimum of four compression bolts 6 are used to put a minimum of 25,000 lb./sq. inch compression force on spacers 10 and accelerator coils 9. This aids in offsetting the reactive forces generated as the expendable head 2 is accelerated through barrel 17. Another storage compartment 19 in the unit 1 would hold a multiplicity of storage batteries along with a battery charger operating off 110 volts. Other ways of achieving the direct current to charge accelerator coils 9 such as homopolar generators also could be used.

Figure 2:
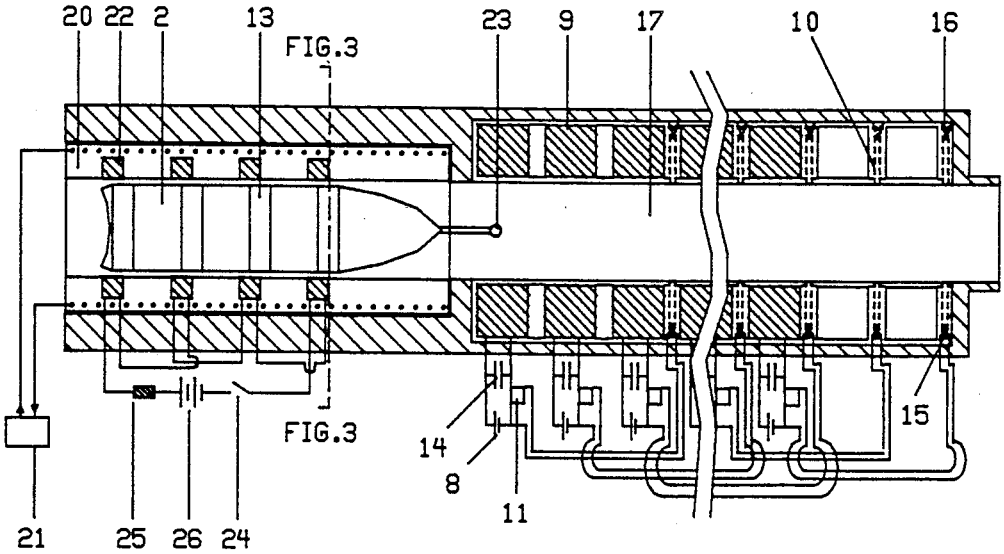
FIG. 2 shows the accelerator with an expendable drill head in firing or serial feed position.

A cut-away view of the basic hardware of the invention is shown in FIG. 2. Accelerator coils 9, also referred to as electromagnetic propellant rings, are made of multiple turns of insulated conductive wire such as copper, wound in a coil with a square cross section and potted in a hard resin. In a preferred embodiment the conductive wire is ribbon shaped. Spacer rings 10 are made of a non-conducting material in a shape similar to the accelerator coils. We've indicated a light source 16 and photoelectrical cells 15 in the spacer rings 10, with one extra at the end of the accelerator. Spacer rings 10 and coils 9 are arranged in a gun barrel like configuration. Leads from accelerator coils 9 go through a nano-second switch 11 such as a Power MOS-FET switch to a D.C. source 8. A variable capacitor 14 is across the leads going to the power source in a preferred embodiment the variable capacitor may be a multiple plate capacitor with multiple take off leads to allow in-service choice of sufficient plates to give desired microfarad capacity. Differing size capacitors 14 vary the frequency of the "ringing" type circuit caused when switch 11 is opened after coils 9 are charged by batteries 8. The expendable drill heads 2 may be held in a storage chamber 20.

The storage chamber 20 serves to position the expendable drill head 2 and also to hold a cooling means 21, FIG. 2, which preferably is liquid nitrogen but any of various cooling means such as refrigeration or liquid carbon dioxide could be used.

In FIG. 2 we show one of the simple versions of the expendable drill head 2. The drill heads have two or more, usually four conductive metal rings 13 and are filled with water which is frozen by cooling means 21. Induction coils 22 induce current in rings 13 when a switch 24 is closed and at peak charge on coils 22, a fusible link 25 opens and electromagnetic forces propel the drill head 2 into barrel 17. When the expendable drill head 2 leaves the mounting position flow of current in the conductive rings 13 creates alternate N-S magnetic fields. Also shown is a tip 23 of a length that properly times opening of nano-second switch 11 by activating photoelectrical cell 15 by interference of tip 23 with a light path of the photoelectric cell 15. Note that on explosive charge or possibly rocket fuel preferably of a solid type could be used to initially propel drill head 2 into barrel 17 compartment.

Figure 3:
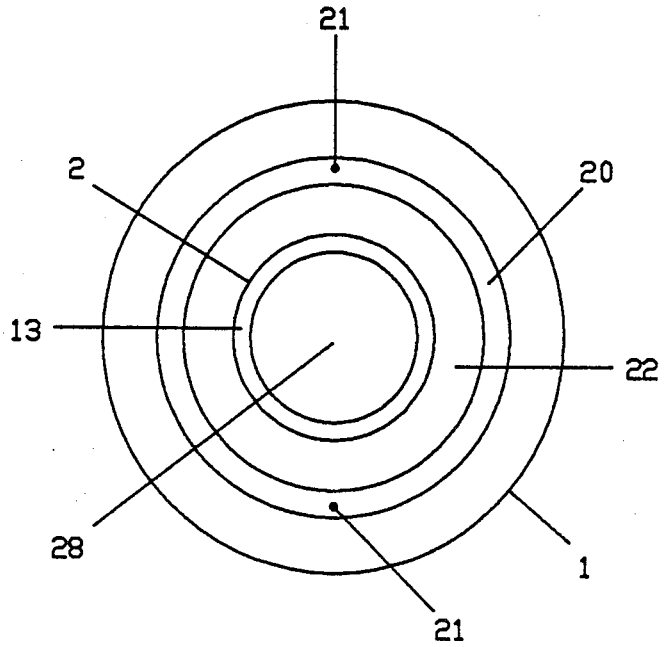
FIG. 3 shows continuous induction rings on the expendable drill head.

FIG. 3 shows the conductive rings 13. These rings are preferably made with aluminum or copper with an oblong cross section. An electromotive force is induced in rings 13 by induction coils 22 and when the charging circuit for induction coils 22 is opened by a switch or fusible link such as an undersized fuse, the interacting electromagnetic force propels the head 2 into the accelerator barrel 17. In one preferred embodiment drill head 2 is filled with ice 28.

Figure 4:
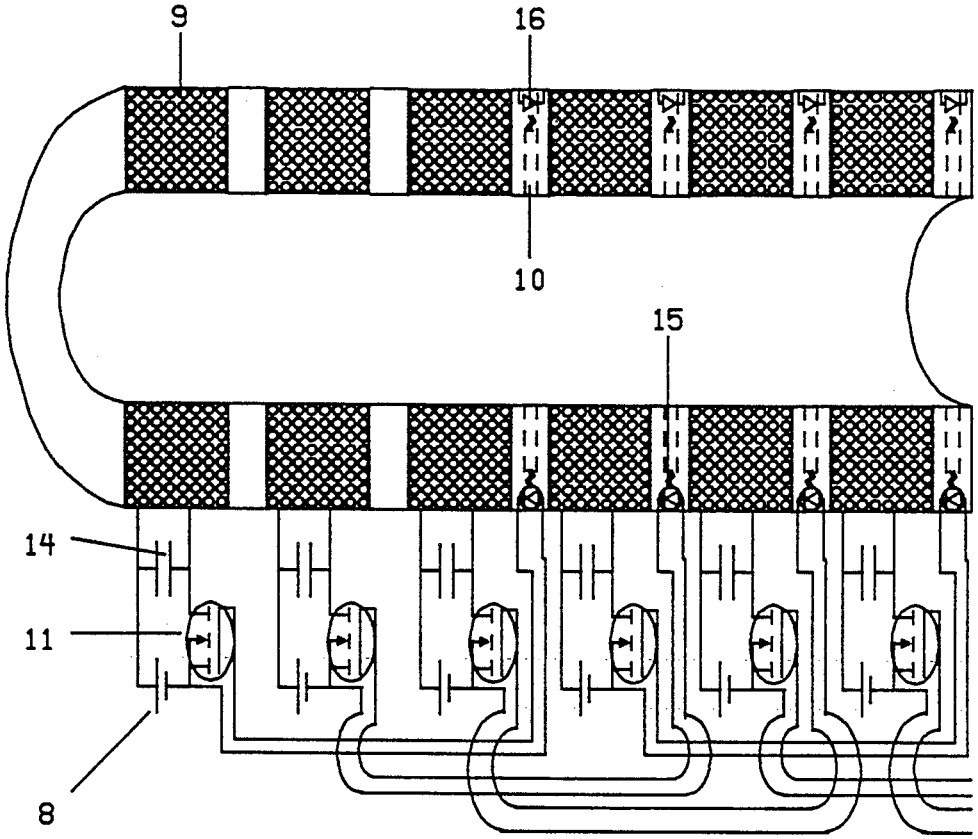
FIG. 4 shows more detail of a accelerator coil circuitry.

FIG. 4 shows electronic circuitry to generate the drive field in propellant ring 9 in the gun barrel-like accelerator with capacitor 14 in parallel with circuitry in propellant ring 9. Both the propellant ring 9 and the variable capacitor 14 are charged by the battery 8 when nano-second switch 11 is closed. Switch 11 is activated by a photoelectric cell 15 whenever the tip 23, FIG. 2, breaks a light beam from light source 16 to the photoelectric cell 15. In some embodiments in propellant rings in the outlet half of the assembly an auxiliary capacitor with a switch may be connected in parallel with leads to the propellant rings 9 to allow electromagnetically aborting or slowing down the drill head.

Two photoelectric sensing switches may be connected with timer circuitry to measure velocity as the expendable drill head 2 moves through the propellant rings 9. Timer circuitry could output a signal to close switches to put extra capacitance in the "ringing" circuit of the exit end propellant rings to slow down the drill head if the velocity is different than a preset speed. When switches are closed on a plurality of rings and with capacitors of a properly chosen size the propellant rings 9 then act to slow or speed up the drill head. In this manner the drill head may be slowed to essentially a stop position or further accelerated.

FIG. 4 shows a cross section of the doughnut shaped electromagnetic accelerator coil 9 wound with an insulated wire which would preferably be copper or aluminum. In spacer ring 10 a photo-electric cell 15 that activates a nano-second switch 11 is shown. Other means of activation such as capacitor means or laser beam means could also be used.

Calculations indicate that with less than thirty electromagnetic accelerator coils 9, using four conductive rings 13 around a cylindrical expendable drill head 2 that, when capacitors 14 are properly sized to vary the frequency of the current to make maximum use of stored electrical energy, velocities of 5 miles per second or more may be reached. Maximum use of electrical energy occurs when N-S, S-N, N-S, etc., magnetic force interaction is such that the first pulse in coils 9 acts to "push" the first conductive ring 13 while pulling the second conductive ring and the second pulse acts to "push" the second conductive ring while pulling the third ring and the third pulse acts to "push" the third ring, etc. As the expendable drill head increases in velocity the second ring comes into the force field generated by the electromagnetic accelerator coils more rapidly. Therefore, for maximum efficiency the frequency of the generated current must increase as the velocity of the expendable drill head increases. This frequency may be increased by reducing the capacitance of the capacitor 14. In this manner, nearly constant acceleration may be achieved. Calculations would indicate some small efficiency increase by varying the spacing of the second, third and fourth conductive rings on the expendable drill head.

With electrical circuit as shown in FIG. 2 the rings 13 will have alternate N-S, S-N, N-S magnetic force field. The induced electromagnetic force in rings 13 exists for sufficient time for acceleration in the range of five miles per second.

Obviously many variations may be made in the structures we've outlined We therefore wish to be limited only as to the general aspects of the various components as outlined for this horizontal earth drilling equipment and method as given in these claims and specifications.

Legend

FIG. 1

1=accelerator unit
2=expendable drill head
3=flat base support
4=adjustable base support feet
5=shock absorbers
6=tension bolts (4)
7=lifting lugs
8=batteries
9=electromagnetic acceleration coils
10=spacer rings
13=conductive rings
17=accelerator barrel
18=adjustable side jacks
19=battery storage
21=cooling means
22=induction coils
27=drill head storage FIG. 2
2=expendable drill head
8=batteries
9=accelerator coils
10=spacer rings
11=nano-second switch
12=explosive charge
13=conductive rings
14=variable capacitor
15=photo-electric cell
20=drill head preacceleration storage
21=cooling means
23=head to interrupt photo beam
24=switch
25=fuse or fusible link
26=D.C. power source FIG. 3
1=accelerator unit
2=expendable drill head
13=conductive rings
21=cooling means such as liquid nitrogen coils
22=induction coils
28=ice FIG. 4
8=battery or source of D.C. current
9=electromagnetic accelerator coils
10=spacer rings
11=nano-second switch
14=variable capacitor
15=photo-electric cell
16=light source

I claim:

1. A high speed electromagnetically accelerated earth drill comprising:
(a) a housing means;
(b) multiple accelerating coil means in said housing means with a cylindrical open center in each of said multiple accelerating coil means;
(c) a D.C. charging means exterior of said housing means with inlet and exit leads to each of said multiple accelerating coil means;
(d) a variable capacitor means connected across said inlet and exit leads;
(e) a nano-second switch located in one of said leads to said D.C. charging means;
(f) a spacer means with a cylindrical open center and containing an activating means for said nano-second switch between each of said multiple accelerating coil means;
(g) a drill head means in said housing means and adapted to pass through said cylindrical open center of each of said multiple accelerating coil means;
(h) a holding means in a beginning end of said housing means to hold said drill head means aligned with said cylindrical open center of each of said multiple accelerating coil means;
(i) a means to create spaced alternating magnetic poles around said drill head means;
(j) a primary accelerating means to propel said drill head means into a first one of said multiple accelerating coil means in said housing means.

2. A high speed electromagnetically accelerated earth drill as in claim 1 wherein said housing means further comprises:
(a) a base adjustable both vertically and horizontally;
(b) a mounting means for said multiple accelerating coil means and said spacer means with said mounting means recoilably connected to said base.

3. A high speed electromagnetically accelerated earth drill as in claim 1 wherein said means to create spaced alternating magnetic poles around said drill head means comprises a minimum of two separate conductive rings with induction coil means in said holding means for said drill head means to induce alternate N-S, S-N magnetic poles in said two separate conductive rings with said two separate conductive rings acting to propel said drill head means into said cylindrical open center of said multiple accelerating coil means when a switch is closed in a D.C. charging means for said induction coil means.

4. A high speed electromagnetically accelerated earth drill as in claim 2 wherein said housing means further comprises storage for multiple batteries, storage for said drill head means, and cooling means for said drill head means.

5. A high speed electromagnetically accelerated earth drill as in claim 1 wherein said D.C. charging means comprises homopolar generators.

6. A high speed electromagnetically accelerated earth drill as in claim 1 wherein said primary accelerating means is electromagnetic interaction between conductive rings on said drill head means and induction coils in said holding means to induce a current in said conductive rings.

7. A high speed electromagnetically accelerated earth drill as in claim 1 wherein said variable capacitor means is a multiple plate capacitor with multiple take off leads to allow in-service choice of sufficient plates to give desired microfared capacity.

8. A high speed electromagnetically accelerated earth drill as in claim 1 wherein each of said multiple accelerating coil means is potted in a rigid plastic.

9. A high speed electromagnetically accelerated earth drill as in claim 1 wherein said activating means for said nano-second switch comprises light generating means in each of said spacer means striking a photoelectrical cell pick up on an opposite side of said cylindrical open center of said spacer means with a light interrupting means mounted on an extended portion of said drill head means activating said photoelectrical cell pick up to activate said nano-second switch.

10. A high speed electromagnetically accelerated earth drill as in claim 1 wherein said drill head means further comprises a hollow cylindrical plastic container encircled with a minimum of two conductive rings and filled with water.

* * * * *